US008011965B2

(12) United States Patent
Zhang

(10) Patent No.: US 8,011,965 B2
(45) Date of Patent: Sep. 6, 2011

(54) ELECTRICAL CARD CONNECTOR

(75) Inventor: Wei-De Zhang, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/978,342

(22) Filed: Dec. 23, 2010

(65) Prior Publication Data

US 2011/0151721 A1 Jun. 23, 2011

(30) Foreign Application Priority Data

Dec. 23, 2009 (CN) ..... 2009 20 318119

(51) Int. Cl.
*H01R 24/00* (2011.01)

(52) U.S. Cl. ..... 439/630

(58) Field of Classification Search ..... 439/630, 439/79, 607.01, 607.02; 235/441
See application file for complete search history.

(56) References Cited

U.S. PATENT DOCUMENTS 7,270,559 B1 * 9/2007 Chen ..... 439/326

FOREIGN PATENT DOCUMENTS

TW M272256 8/2005

* cited by examiner

*Primary Examiner* — Javaid Nasri
(74) *Attorney, Agent, or Firm* — Wei Te Chung; Ming Chieh Chang; Andrew C. Cheng

(57) ABSTRACT

An electrical card connector includes an insulative housing (1), a number of contacts (3) assembled in the insulative housing, a pair of metal pads (5) assembled to the side walls of the insulative housing, and a metallic shell (2). The insulative housing has a base portion (10) and a pair of side walls (11) extending from the base portion. Each metal pad has a cavity (501) and an elastic tongue portion (53) extending into the cavity. The metallic shell forms a pair of pivots (220) extending through and movable in the cavity. The elastic tongue portion is resiliently engageable with the pivot in response to a movement of the pivot along an inner edge of the cavity.

16 Claims, 4 Drawing Sheets

ELECTRICAL CARD CONNECTOR

BACKGROUND OF THE INVENTION

1. Field of the Invention

The present invention relates generally to an electrical card connector, and more particularly to an electrical card connector more conveniently operated by a user when the user pivotally assembles the shell to the insulative housing.

2. Description of Related Arts

According to rapid developments of electronic products, such as mobile phones, digital cameras, etc, the electronic products are muli-functioned to meet with different requirements of customers. The own capacity of the electronic products are not large enough for memorizing so such information. External, portable electrical cards are invented for adding capacity of the electronic products and accordingly, electrical card connectors are popularly assembled on printed circuit boards of the electronic products for receiving the electrical cards. The electrical card connectors transmit signals between the electrical cards and the electronic products.

Taiwan Pat. No. M272256 issued on Aug. 1, 2005 discloses a card connector. The card connector includes an insulative housing, a plurality of contacts received in the insulative housing, a metal cover pivotally assembled onto the insulative housing, and a pair of metal pads assembled between the insulative housing and the metal cover. The metal pads may be soldered on a printed circuit board for discharging static charges accumulated on the metal cover. The insulative housing forms a pivoting portion and the metal pad defines a pivoting slot. The metal cover forms a pivot extending through the pivoting slot and secured on the pivoting portion. The metal pad comprises a fixing portion retained on the pivoting portion, a flat portion defining the pivoting slot and contacting with the metal cover for grounding, and a soldering portion connecting the fixing portion and the flat portion. The user pivots the metal cover from an opening position towards a closed position relative to the insulative housing, such that the pivot moves in the pivoting slot. Because the pivot engages rigid inner walls of the pivoting slot, the pivot is prone to be damaged. Or the pivot may be difficult to move in the pivoting slot, thus frustrating operation of the user.

Hence, an electrical card connector that can be more conveniently operated by a user is desired.

SUMMARY OF THE INVENTION

Accordingly, an object of the present invention is to provide an electrical card connector that can be more conveniently operated by a user.

To achieve the above object, an electrical card connector includes an insulative housing, a number of contacts assembled in the insulative housing, a pair of metal pads assembled to the side walls of the insulative housing, and a metallic shell. The insulative housing has a base portion and a pair of side walls extending from the base portion. Each metal pad has a cavity and an elastic tongue portion extending into the cavity. The metallic shell forms a pair of pivots extending through and movable in the cavity. The elastic tongue portion is resiliently engageable with the pivot in response to a movement of the pivot along an inner edge of the cavity.

Other objects, advantages and novel features of the invention will become more apparent from the following detailed description when taken in conjunction with the accompanying drawings.

DETAILED DESCRIPTION OF THE PREFERRED EMBODIMENT

Figure 1:
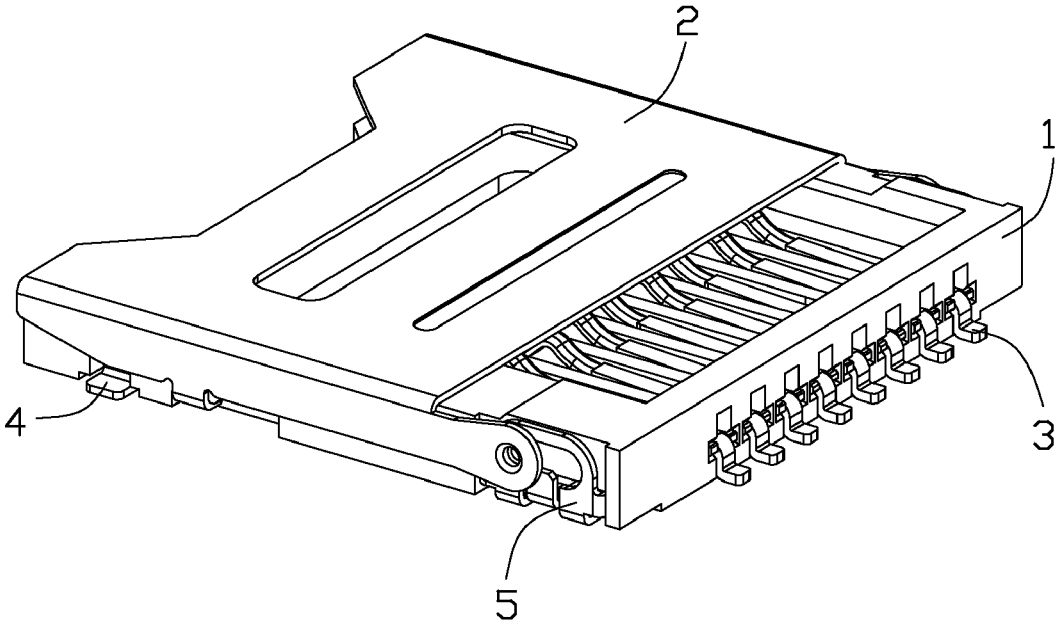
FIG. 1 is a perspective, assembled view of an electrical card connector constructed in accordance with the present invention.

Reference will now be made in detail to the preferred embodiment of the present invention.

Referring to FIGS. 1-4, an electrical card connector (not labeled) in accordance with the present invention, comprises an insulative housing 1, a plurality of contacts 3 retained in the insulative housing 1, a metallic shell 2 pivotally covering the insulative housing 1, a pair of fixing pads 4 and a pair of metal pads 5 assembled at opposite ends of the insulative housing 1. The fixing pads 4 and the metal pads 5 are adapted for soldering a printed circuit board (not shown) and therefore, the insulative housing 1 is positioned on the printed circuit board.

Figure 2:
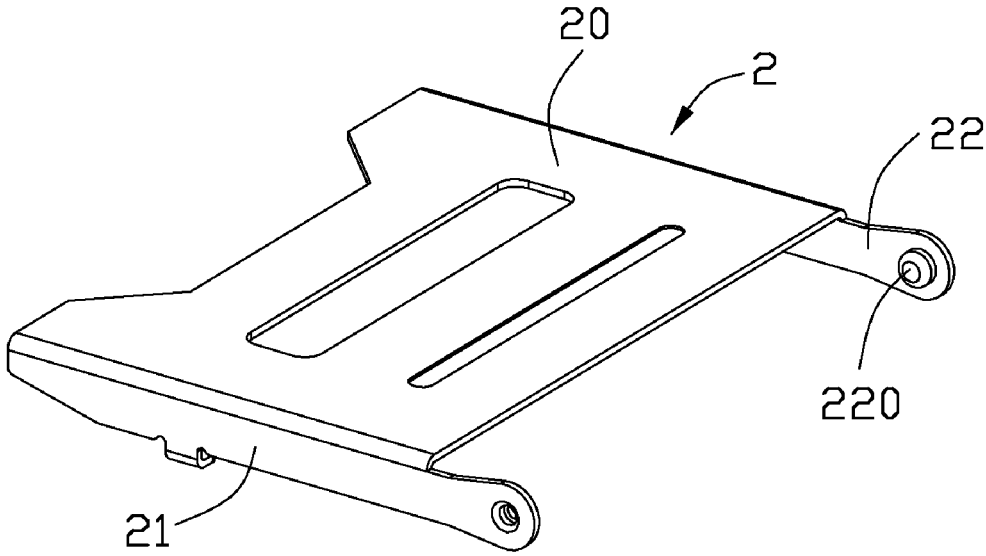
FIG. 2 is a perspective, partly exploded view of the electrical card connector when a metallic shell is separated away from the insulative housing.
Figure 2:
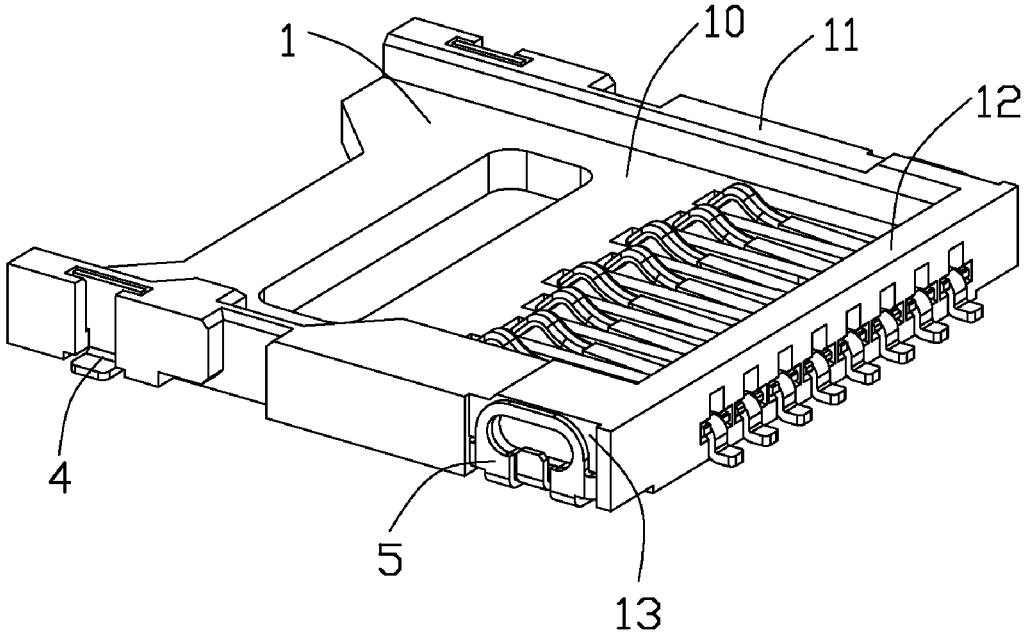
Figure 3:
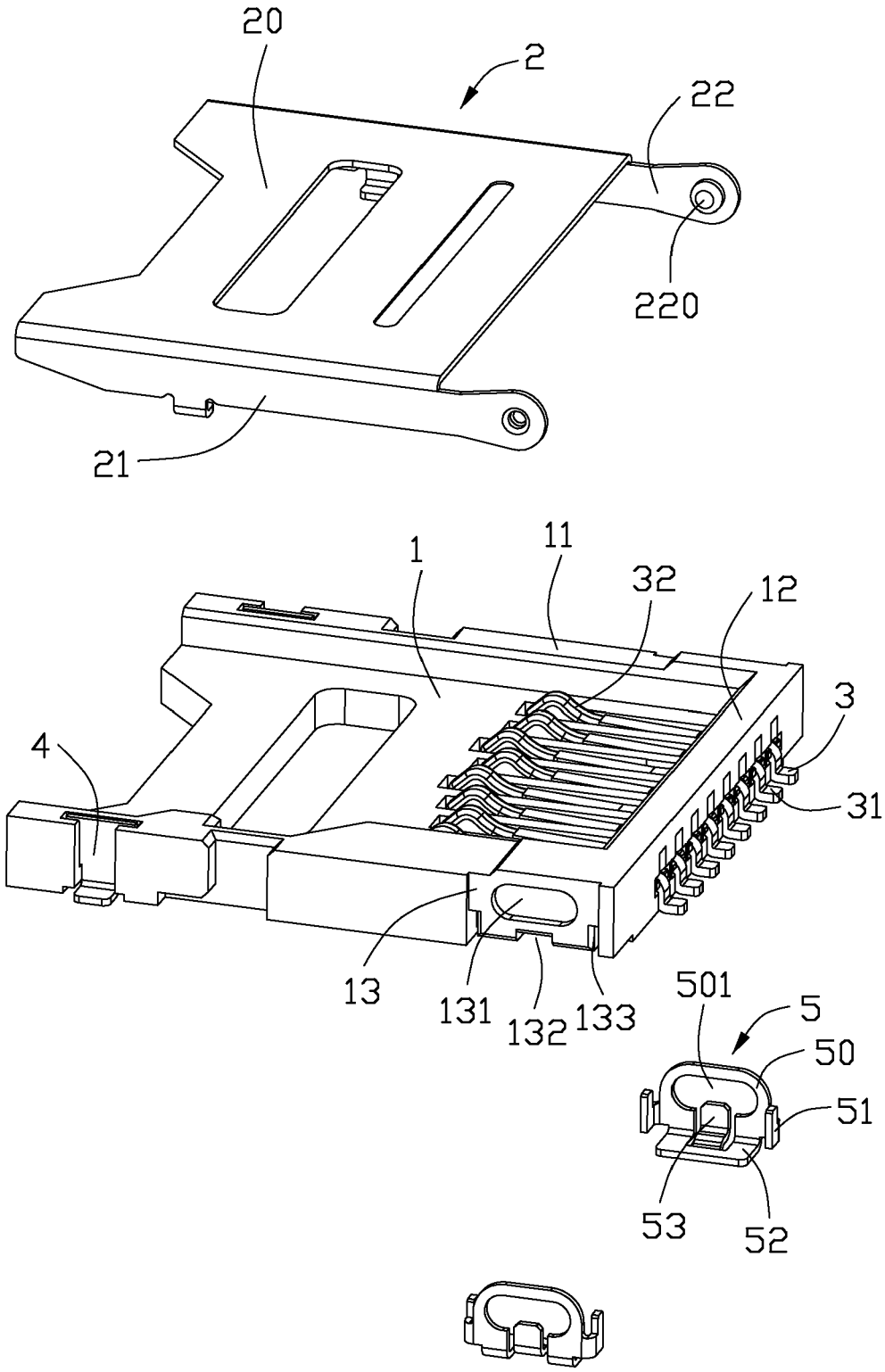
FIG. 3 is a perspective, fully exploded view of FIG. 2.

Referring to FIGS. 2-3, the insulative housing 1 comprises a base portion 10, a pair of side walls 11 extending upwardly from the base portion 10, and a rear wall 12 connecting with the side walls 11. The contacts 3 are retained in the insulative housing 1, having a plurality of contacting portions 32 extending beyond the base portion 10 into a card receiving space for connecting with an inserted card and a plurality of soldering portions 31 extending rearward from the contacting portions 32. The soldering portions 31 extend out of the insulative housing 1 from the rear wall 12 for soldering on the printed circuit board. At two rear parts of the side walls 11 adjacent to the rear wall 12, the insulative housing 1 defines a secured portion 13. The secured portion 13 has an elongated recessed portion 131 at the middle part thereof, a slot 132 extending below the recessed portion 131 and towards the recessed portion 131, and a pair of slits 133 at two sides of the slot 132 which extend higher than the slot 132. Opposite to the secured portion 13, the insualtive housing 1 defines a retention portion (not labeled) at each side wall 11 for positioning the fixing pad 4.

Referring to FIGS. 1-3, the metallic shell 2 comprise a main portion 20, a pair of lateral walls 21 extending vertically from the main portion 20, and a pair of pivoting arms 22 extending horizontally from the lateral walls 21. Each pivoting arm 22 forms a pivot 220 inwardly. The pivots 220 face towards each other.

Figure 4:
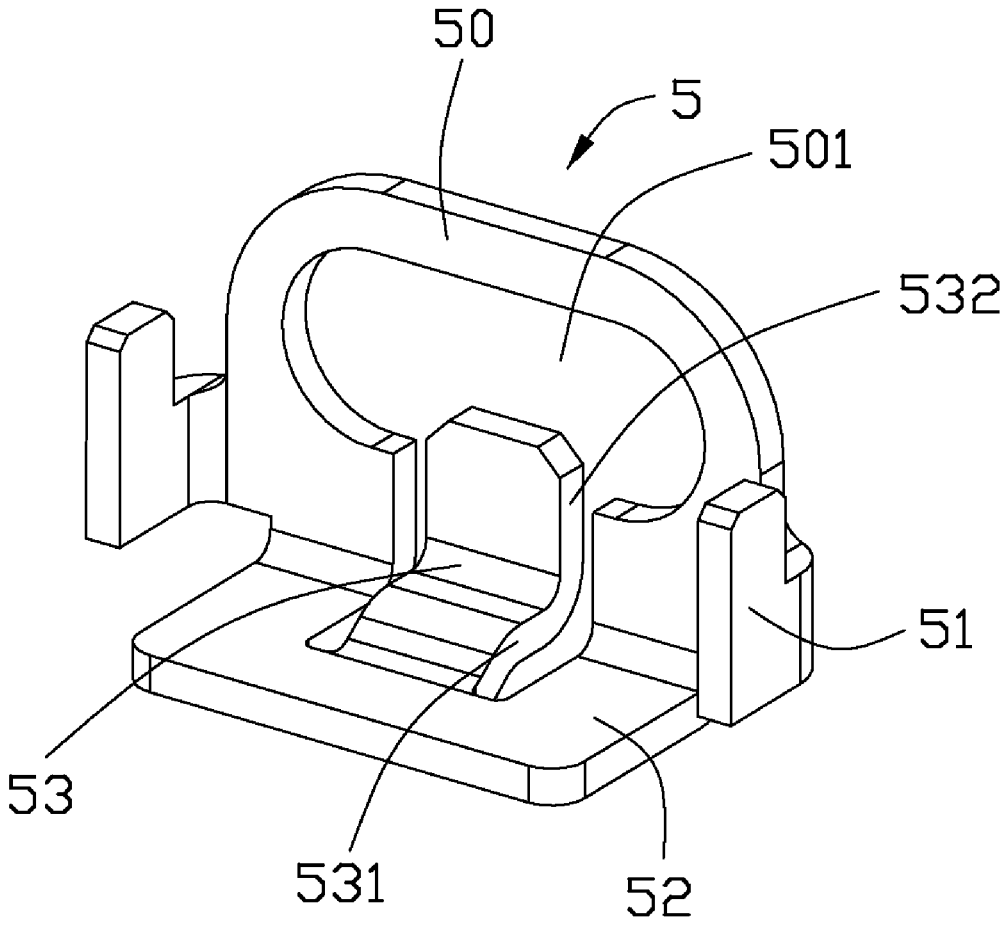
FIG. 4 is a perspective view of the metal pad.

Referring to FIGS. 3 and 4, the metal pad 5 is metallic and comprise a vertical portion 50 defining a cavity 501, a horizontal portion 52 bent outwardly from the vertical portion 50, a pair of wing portions 51 at two sides of the vertical portion 50, and an elastic tongue portion 53 extending curvedly, upwardly from the horizontal portion 52 into the cavity 501. The elastic tongue portion 53 comprises a free end portion 532 in a vertical plane as the vertical portion 50 and a connecting portion 531 connected between the free end portion 532 and the horizontal portion 52. The horizontal portion 52 is used for soldering on the printed circuit board.

Referring to FIGS. 1-4, the wing portions 51 are correspondingly secured into the slits 133 and accordingly, the metal pad 5 is assembled at the secured portion 13. The connecting portion 531 of the elastic tongue portion 53 is correspondingly received in the slot 132 and the free end portion 532 of the elastic tongue portion 53 is exposed outside of the recessed portion 131. The cavity 501 corresponds to the recessed portion 131 at the same altitude. The pivot 220 of the metallic shell 2 extends through the cavity 501 and is secured into the recessed portion 131. When the free end portion 532 is pressed against by the pivot 220, the connecting portion 531 is deformed and the free end portion 532 moves from an original, upper position to a lower position. The slot 132 provides enough space for deformation of the connecting portion 531. The connecting portion 531 has elasticity and the free end portion 532 is capable of returning back to the original, upper position when the elasticity of the connecting portion 531 is released. Accordingly, the cavity 501 is small when the free end portion 532 is positioned at the original, upper position and the cavity 501 becomes larger when the free end portion 532 is positioned at the lower position.

In the present invention, because of the elasticity of the connecting portion 531, the free end portion 532 is capable of adjusting the cavity 501. Moreover, during crossing of the pivot 220 over the free end portion 532, the user may sensibly feels movement of the metallic shell 2 during its locking with or unlocking from the insulative housing 1. The pivot 220 and the metal pad 5 are elastically engaged. No damage is caused between the pivot 220 and the metal pad 5. The static is discharged from the metallic shell 2 through the metal pad 5.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical card connector comprising:

an insulative housing having a base portion and a pair of side walls;

a plurality of contacts assembled in the base portion of the insulative housing;

a pair of metal pads assembled to the side walls of the insulative housing, each metal pad having a cavity and an elastic tongue portion extending into the cavity; and a metallic shell having a pair of pivots extending through and movable in the cavity; wherein the elastic tongue portion is resiliently engageable with the pivot in response to a movement of the pivot along an inner edge of the cavity.

2. The electrical card connector as claimed in claim 1, wherein the metal pad comprises a vertical portion and a horizontal portion bent outwardly from the vertical portion, the cavity is defined on the vertical portion, and the elastic tongue portion extends upwardly from the horizontal portion into the cavity.

3. The electrical card connector as claimed in claim 2, wherein the elastic tongue portion comprises a free end portion interfering the pivot and a connecting portion connected between the free end portion and the horizontal portion, and the elastic tongue portion is downwardly moveable by the pivot.

4. The electrical card connector as claimed in claim 3, wherein the insulative housing defines a slot receiving the connecting portion and the slot provides a space for movement of the connecting portion.

5. The electrical card connector as claimed in claim 4, wherein the metal pad has a pair of wing portions, and the insulative housing defines a pair of slits receiving the wing portions.

6. The electrical card connector as claimed in claim 4, wherein the insulative housing defines an elongated recessed portion receiving the pivot.

7. The electrical card connector as claimed in claim 2, further comprising a pair of fixing pads assembled at an end of the insulative housing opposite to the metal pads, both the fixing pads and the metal pads are being adapted for soldering on a printed circuit board.

8. An electrical card connector comprising:

an insulative housing defining a card receiving space and a pair of securing portions around one end of the housing;

a plurality of contacts disposed in the housing with contacting sections extending into the card receiving space;

a metallic cover defines at one end a pair of pivots respectively assembled around the securing portions; and a pair of metal pads assembled to the corresponding securing portions, respectively; wherein each of said metal pads defines a cavity to receive the corresponding pivot therein and further defines an elastic portion to divide said cavity into opposite first and second regions under condition that the pivot is allowed to move within the cavity and retained in said opposite first and second regions, respectively, by said elastic portion.

9. The electrical card connector as claimed in claim 8, wherein each of the metal pads includes a horizontal section, in a first plane, from which the elastic portion extends, and a vertical section, in a second plane perpendicular to the first plane, in which said cavity is formed.

10. The electrical card connector as claimed in claim 9, wherein each of said metal pads further includes a pair of wings each extending from the vertical section in a third plane perpendicular to both said first plane and said second plane.

11. The electrical card connector as claimed in claim 10, wherein said metal pad is assembled to the housing via said pair of wings.

12. The electrical card connector as claimed in claim 8, wherein when the pivot is located in the first position, the cover is locked by the housing; when the pivot is located in the second position, the cover is unlocked from the housing.

13. An electrical card connector comprising: an insulative housing defining a card receiving space and a pair of securing portions around one end of the housing; a plurality of contacts disposed in the housing with contacting sections extending into the card receiving space; a metallic cover defines at one end a pair of pivots respectively assembled around the securing portions; and a pair of metal pads assembled to the corresponding securing portions, respectively, each of said pads including a vertical section defining a cavity therein and a securing tab extending from the vertical section to retain the pad to the housing; wherein the cavity is dimensioned to be large enough to allow the corresponding pivot to move in a front-to-back direction between opposite first and second positions, if a large force is applied thereto, and also to be small enough to cooperate with a protrusion, which is located in a middle region of the cavity, to have the pivot stably retained in the first position and the second, respectively, if no force or a small force is applied thereto, wherein said protrusion is formed one the pad, wherein said protrusion is formed on an elastic portion, where said elastic portion extends from a horizontal section which unitarily extends from a lower edge of the vertical section.

14. The electrical card connector as claimed in claim 13, wherein said horizontal section is essentially located and hidden under the housing.

15. The electrical card connector as claimed in claim 13, wherein said securing tab extends in a vertical plane perpendicular to said vertical section.

16. The electrical card connector as claimed in claim 15, wherein the housing is configured to allow said securing tab to be assembled thereto only in an upward direction.

* * * * *